US007156234B2

(12) United States Patent
Ishibashi et al.

(10) Patent No.: US 7,156,234 B2
(45) Date of Patent: Jan. 2, 2007

(54) SORTING TECHNIQUE FOR RECYCLE OF DEVICE UNITS

(75) Inventors: Osamu Ishibashi, Nagano-ken (JP); Akira Maruyama, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 309 days.

(21) Appl. No.: 10/798,901

(22) Filed: Mar. 12, 2004

(65) Prior Publication Data

US 2005/0007409 A1 Jan. 13, 2005

(30) Foreign Application Priority Data

Mar. 13, 2003 (JP) ..... 2003-068533

(51) Int. Cl.
*B07C 5/02* (2006.01)

(52) U.S. Cl. ..... 209/3.1; 209/564; 209/509; 347/19

(58) Field of Classification Search ..... 209/3.1, 209/3.2, 3.3, 564, 538, 509, 524, 576, 644, 209/645, 511, 520; 347/19
See application file for complete search history.

(56) References Cited

U.S. PATENT DOCUMENTS 5,738,224 A * 4/1998 Sommer et al. ..... 209/588
5,901,854 A * 5/1999 Ishii ..... 209/538
5,943,231 A * 8/1999 Thomas ..... 700/28
6,504,124 B1 * 1/2003 Doak ..... 209/581
6,531,672 B1 * 3/2003 Malloy ..... 209/579
6,779,668 B1 * 8/2004 Nagler ..... 209/617
6,805,245 B1 * 10/2004 Kenneway ..... 209/538
2002/0060174 A1 * 5/2002 Nakajima ..... 209/644

FOREIGN PATENT DOCUMENTS

EP 1 041 455 A2 10/2000
EP 1 109 073 A2 6/2001
JP 2001-055201 A 2/2001
JP 2002-304095 A 10/2002

* cited by examiner

*Primary Examiner*—CongVan Tran
(74) *Attorney, Agent, or Firm*—Sughrue Mion, PLLC

(57) ABSTRACT

The sorting apparatus receives the electromagnetic wave from a storage element of a collected toner cartridge, and specifies the recyclability of the toner cartridge based on information extracted from the received electromagnetic wave. The sorting system then sorts out the toner cartridge, in order to send the toner cartridge to a selected one of the sorting areas, based on the results of the specification of recyclability of the toner cartridge, the feed roller, and the development roller. Subsequently, the sorting system controls one of sorting units to guide the toner cartridge to the selected sorting area and registers the results of sorting into a sorting database.

18 Claims, 10 Drawing Sheets

Fig. 6

| |
|---|
| Cartridge ID |
| Color of Toner |
| Number of Recycles of Toner Cartridge |
| Number of Recycles of Feed Roller |
| Number of Recycles of Development Roller |
| Printer ID |
| Model |
| Residual Amount of Toner |

Fig. 8

| Cartridge | Feed Roller | Development Roller | Subsequent Operation | Sorting Area |
|---|---|---|---|---|
| ○ | ○ | ○ | Supplement of Toner | 34a |
| ○ | ○ | × | Replacement of Part | 34b |
| ○ | × | ○ | Replacement of Part | |
| ○ | × | × | Replacement of Part | |
| × | — | — | Wastage | 34c |

○ ··· Recyclable
× ··· Unrecyclable

Fig. 9

| |
|---|
| Cartridge ID |
| Color of Toner |
| Requirement or Non-requirement for Replacement of Feed Roller |
| Requirement or Non-requirement for Replacement of Development Roller |
| Residual Amount of Toner |

SORTING TECHNIQUE FOR RECYCLE OF DEVICE UNITS

BACKGROUND OF THE INVENTION

1. Field of the Invention

The present invention relates to a sorting technique for recycle of device units. More specifically, the invention relates to a sorting apparatus that sorts out a object unit included in a predetermined device for recycle and a corresponding sorting method, as well as an operation verification apparatus that verifies a recycling-related operation.

2. Description of the Prior Art

A certain unit included in an image formation device, for example, a recording material cartridge, is generally collected for recycle (see, for example, Patent Laid-Open Gazette No. 2001-55201). The recycling procedure checks out the respective parts of each object unit and performs required operations (for example, cleaning and replacement of parts) for recycling.

The recycling procedure unpacks each collected object unit, visually examines the respective parts of the object unit, and specifies the recyclability of the object unit according to the extent of deterioration of the respective parts. In many cases, this series of operations is manually performed and undesirably increases the recycling cost. Unpacking and visual examination are required for even units that are not recyclable and are to be wasted. Namely the time-consuming labor is wasted for the units having no advantage of recycle.

SUMMARY OF THE INVENTION

The object of the present invention is to sort out each collected object unit efficiently for recycle. The object of the invention is further to readily acquire information regarding the unit.

In order to achieve at least a part of the aforementioned objects, the present invention is constructed as follows.

A sorting apparatus of the present invention is an apparatus that sorts out a collected object unit for recycle, where the object unit is included in a predetermined device and has a storage element, which stores information regarding the object unit and sends the stored information on an electromagnetic wave in a predetermined frequency band, in response to reception of a specific electromagnetic wave in the predetermined frequency band, the sorting apparatus including: an electromagnetic wave transmission module that sends the specific electromagnetic wave in the predetermined frequency band to a preset coverage area; an information reception module that receives the information regarding the object unit, which is carried on the electromagnetic wave in the predetermined frequency band and is sent from the storage element of the collected object unit entering the preset coverage area, in response to transmission of the specific electromagnetic wave in the predetermined frequency band; and a sorting module that sorts out the object unit for recycle, based on the received information regarding the object unit.

The sorting apparatus of the invention sends a specific electromagnetic wave in a predetermined frequency band to a preset coverage area, receives information regarding an object unit sent from a storage element of the object unit that enters the preset coverage area, and sorts out the object unit for recycle, based on the received information. This arrangement efficiently sorts out each collected object unit for recycle, based on the received information regarding the object unit that enters the preset coverage area, in response to transmission of the specific electromagnetic wave in the predetermined frequency band. Here, the predetermined device may be an image formation device that forms an image on a medium like paper, and the object unit may be any one of a recording material cartridge, a photoreceptor unit, a transfer unit, and a fixation unit.

In accordance with one preferable application of the sorting apparatus of the present invention, the sorting module includes a recyclability specification module that specifies recyclability of the object unit, based on the received information regarding the object unit, and the sorting module sorting out the object unit according to the specified recyclability. In this application, as one aspect, the information regarding the object unit may include a record on a number of recycles of the object unit or on a number of recycles of a component included in the object unit, and the recyclability specification module may determine that the object unit is recyclable when the number of recycles is not greater than a preset number of times. In this application, as another aspect, the object unit may be a recording material cartridge of an image formation device, the information regarding the object unit may include information on a residual amount of a recording material, and the recyclability specification module may determine that the object unit is recyclable when the residual amount of the recording material is not less than a preset level. The sorting module in this application, when the recyclability specification module determines that the object unit is recyclable, may specify a recycling-related operation based on the received information regarding the object unit and sorts out the object unit corresponding to the specified recycling-related operation.

As one preferable embodiment, the sorting apparatus of the present invention further includes: an information storage module that stores the information received by the information reception module and information regarding a result of sorting by the sorting module; and a support information output module that outputs support information for a recycling-related operation, based on the information stored in the information storage module.

As another preferable embodiment, the sorting apparatus of the present invention further includes a sorting unit control module that controls a sorting unit, which actually sorts out the object unit according to a result of sorting of the object unit by the sorting module.

An operation verification apparatus of the present invention is an apparatus that verifies a recycling-related operation of an object unit, which is included in a predetermined device and is sorted out for recycle by a sorting apparatus, the operation verification apparatus including: an information acquisition module that acquires information regarding the object unit after the recycling-related operation from a storage element of the object unit; and a verification module that verifies the recycling-related operation, based on a result of comparison between the acquired information and information on sorting of the object unit stored in an information storage module of the sorting apparatus.

The operation verification apparatus of the invention verifies a recycling-related operation, based on a result of comparison between the information acquired from the storage element of the object unit after the recycling-related operation and the information on sorting of the object unit stored in the information storage module of the sorting apparatus. This arrangement adequately verifies the recycling-related operation. Here, a sorting apparatus that sort out an object unit for recycle may preferably be the sorting apparatus described above.

A sorting method of the present invention is a method that sorts out a collected object unit for recycle, where the object unit is included in a predetermined device and has a storage element, which stores information regarding the object unit and sends the stored information on an electromagnetic wave in a predetermined frequency band, in response to reception of a specific electromagnetic wave in the predetermined frequency band, the sorting method including the steps of: (a) sending the specific electromagnetic wave in the predetermined frequency band to a preset coverage area; (b) receiving the information regarding the object unit, which is carried on the electromagnetic wave in the predetermined frequency band and is sent from the storage element of the collected object unit entering the preset coverage area, in response to transmission of the specific electromagnetic wave in the predetermined frequency band; and (c) sorting out the object unit for recycle, based on the received information regarding the object unit.

The sorting method of the invention sends a specific electromagnetic wave in a predetermined frequency band to a preset coverage area, receives information regarding an object unit sent from a storage element of the object unit that enters the preset coverage area, and sorts out the object unit for recycle, based on the received information. This arrangement efficiently sorts out each collected object unit for recycle, based on the received information regarding the object unit that enters the preset coverage area, in response to transmission of the specific electromagnetic wave in the predetermined frequency band. Here, the predetermined device may be an image formation device that forms an image on a medium like paper, and the object unit may be any one of a recording material cartridge, a photoreceptor unit, a transfer unit, and a fixation unit.

In accordance with one preferable application of a sorting method of the present invention, the step (c) includes the step (c1) that specifies recyclability of the object unit, based on the received information regarding the object unit, and the step (c2) that sorts out the object unit according to the specified recyclability. In this application, as one aspect, the information regarding the object unit may include a record on a number of recycles of at least one of components included in the object unit, and the step (c1) may determine that the object unit is recyclable when the number of recycles is not greater than a preset number of times. In this application, as another aspect, the object unit may be a recording material cartridge of an image formation device, the information regarding the object unit may include information on a residual amount of a recording material, and the step (c1) may determine that the object unit is recyclable when the residual amount of the recording material is not less than a preset level. In this application, the step (c2), when the step (c1) determines that the object unit is recyclable, may specify a recycling-related operation based on the received information regarding the object unit and sorts out the object unit corresponding to the specified recycling-related operation.

In accordance with another preferable application, the sorting method of the present invention further include the step of controlling a sorting unit, which actually sorts out the object unit according to a result of sorting of the object unit by the step (c).

BRIEF DESCRIPTION OF THE DRAWINGS

FIG. 6 shows an example of the information stored in the storage element 50;

FIG. 8 is a map showing a subsequent operation and the selection of a sorting area with respect to each combination of results of the specification of recyclability;

FIG. 9 shows an example of information under management in a sorting database 26.

DESCRIPTION OF THE PREFERRED EMBODIMENTS

Figure 1:
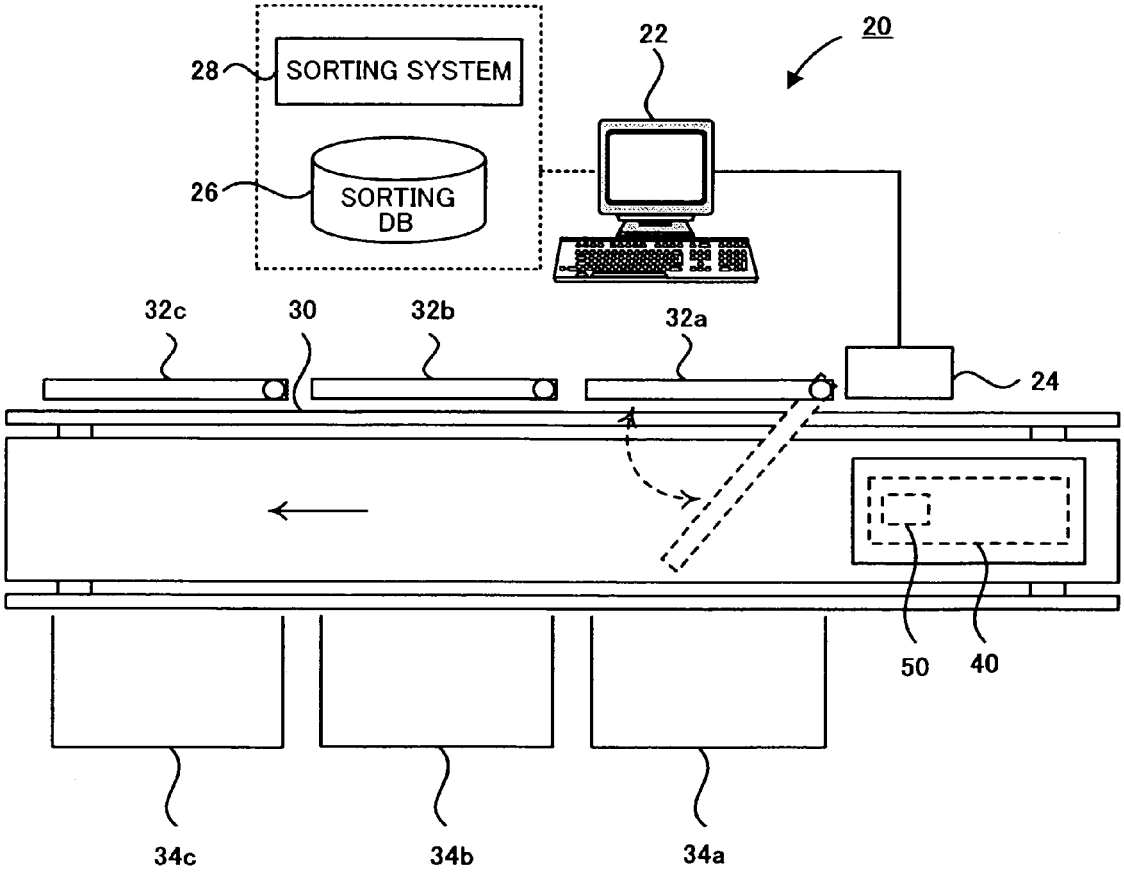
FIG. 1 schematically illustrates the configuration of a system including a sorting apparatus 20.
Figure 2:
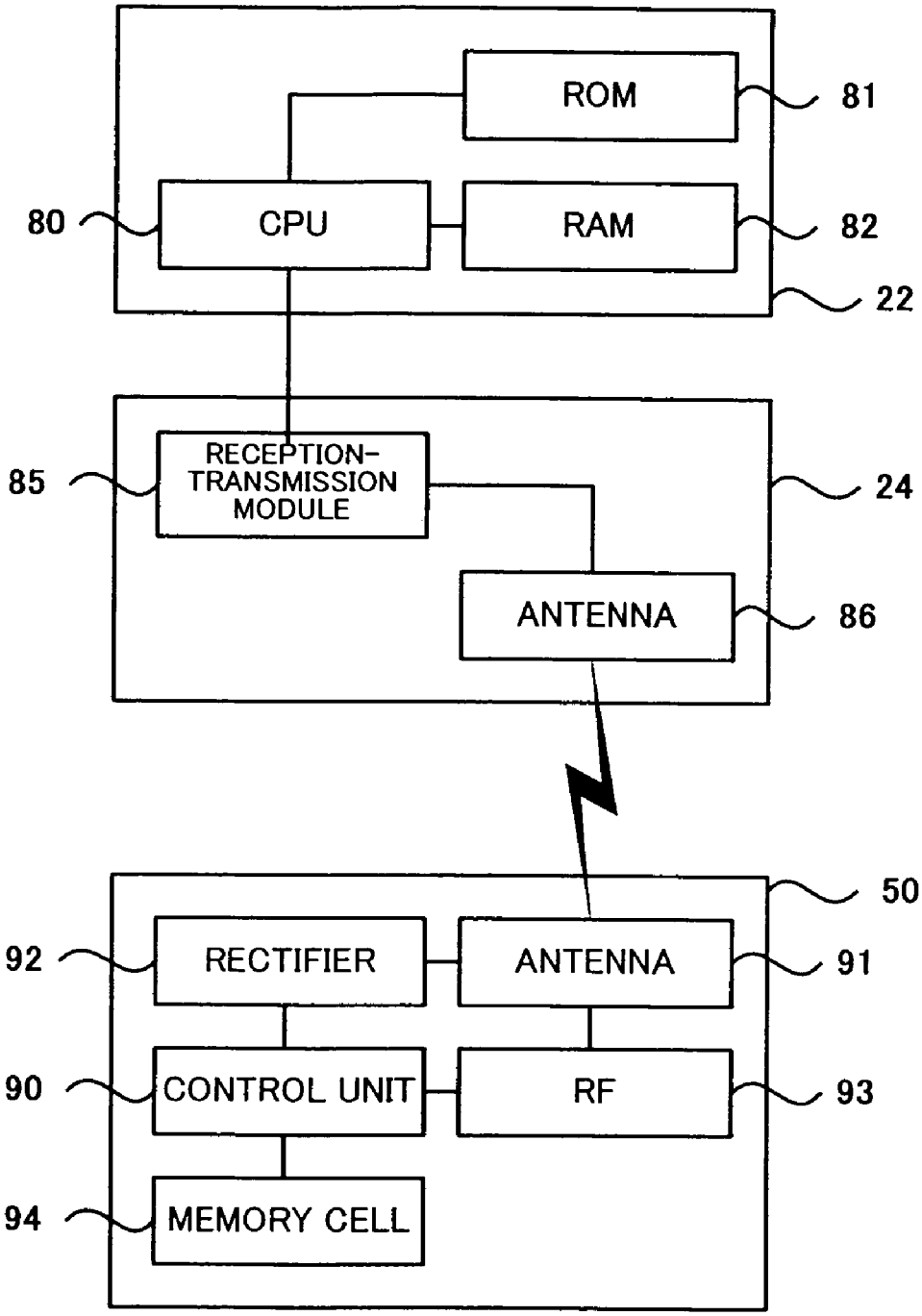
FIG. 2 schematically illustrates the configurations of a receiver-transmitter 24 and a storage element 50 of a toner cartridge 40.

One mode of carrying out the invention is discussed below as a preferred embodiment. FIG. 1 schematically illustrates the configuration of a system including a sorting apparatus 20 that sorts out each toner cartridge 40 for recycling in one embodiment of the invention. FIG. 2 schematically illustrates the configuration of parts relating to transmission of electromagnetic waves between a receiver-transmitter 24 included in the sorting apparatus 20 and a storage element 50 of the toner cartridge 40 in the embodiment. As shown in FIGS. 1 and 2, the sorting apparatus 20 of the embodiment includes a general computer 22 having a CPU 80, a ROM 81, a RAM 82, and an input-output interface (not shown), and the receiver-transmitter 24 that receives and transmits electromagnetic waves in a predetermined frequency band (for example, in a 13.56 MHz band or a 2.4 GHz band) by means of a reception-transmission module 85 and an antenna 86. The sorting apparatus 20 receives information from the storage element 50 of each used toner cartridge 40, which has been collected and is conveyed along a conveyor belt 30, and sorts out the toner cartridge 40 based on the received information. A sorting system 28 that executes a process of sorting out each toner cartridge 40 and a sorting database 26 that stores information regarding the sorting of each toner cartridge 40 in the form of a database are installed in the computer 22.

As shown in FIG. 2, the storage element 50 of the toner cartridge 40 has an antenna 91 that receives and transmits the electromagnetic waves in the predetermined frequency band to receive and send signals, a rectifier 92 that rectifies the received electromagnetic waves and supplies the energy of the rectified electromagnetic waves as electric power, a signal analyzing RF (radio frequency) 93 that analyzes each received signal, a memory cell 94 that stores information, and a control unit 90 that writes information into the memory cell 94 in response to the signal received by the antenna 91 and analyzed by the signal analyzing RF 93 and sends the information stored in the memory cell 94 from the antenna 91 via the signal analyzing RF 93. In the sorting apparatus 20 of the embodiment, the receiver-transmitter 24 repeatedly sends an electromagnetic wave with a signal set to trigger acquisition of information (hereafter referred to as the information-acquisition electromagnetic wave). As the toner cartridge 40 is conveyed along the conveyor belt 30, the storage element 50 of the toner cartridge 40 enters a preset coverage (for example, in an area of 10 cm in radius)

of the receiver-transmitter 24, in which transmission of electromagnetic waves between the receiver-transmitter 24 and the storage element 50 is allowed. While the storage element 50 of the toner cartridge 40 is in the preset coverage, the antenna 91 functions to receive the information-acquisition electromagnetic wave and to send the information stored in the memory cell 94 via the signal analyzing RF 93.

The conveyor belt 30 is designed to convey toner cartridges 40 packed in, for example, cardboard boxes, in the direction of an arrow shown in FIG. 1. The conveyor belt 30 has sorting units 32*a* through 32*c* for sorting out the conveyed toner cartridges 40. The sorting units 32*a* through 32*c* are typically arranged in parallel with the moving direction of the conveyor belt 30. The sorting units 32*a* through 32*c* respectively rotate to allow or prohibit further conveyance of each conveyed toner cartridge 40 in response to a control signal input from the sorting apparatus 20 of the embodiment via a signal line (not shown), and guide the toner cartridge 40 to one of corresponding sorting areas 34*a* through 34*c*.

Figure 3:
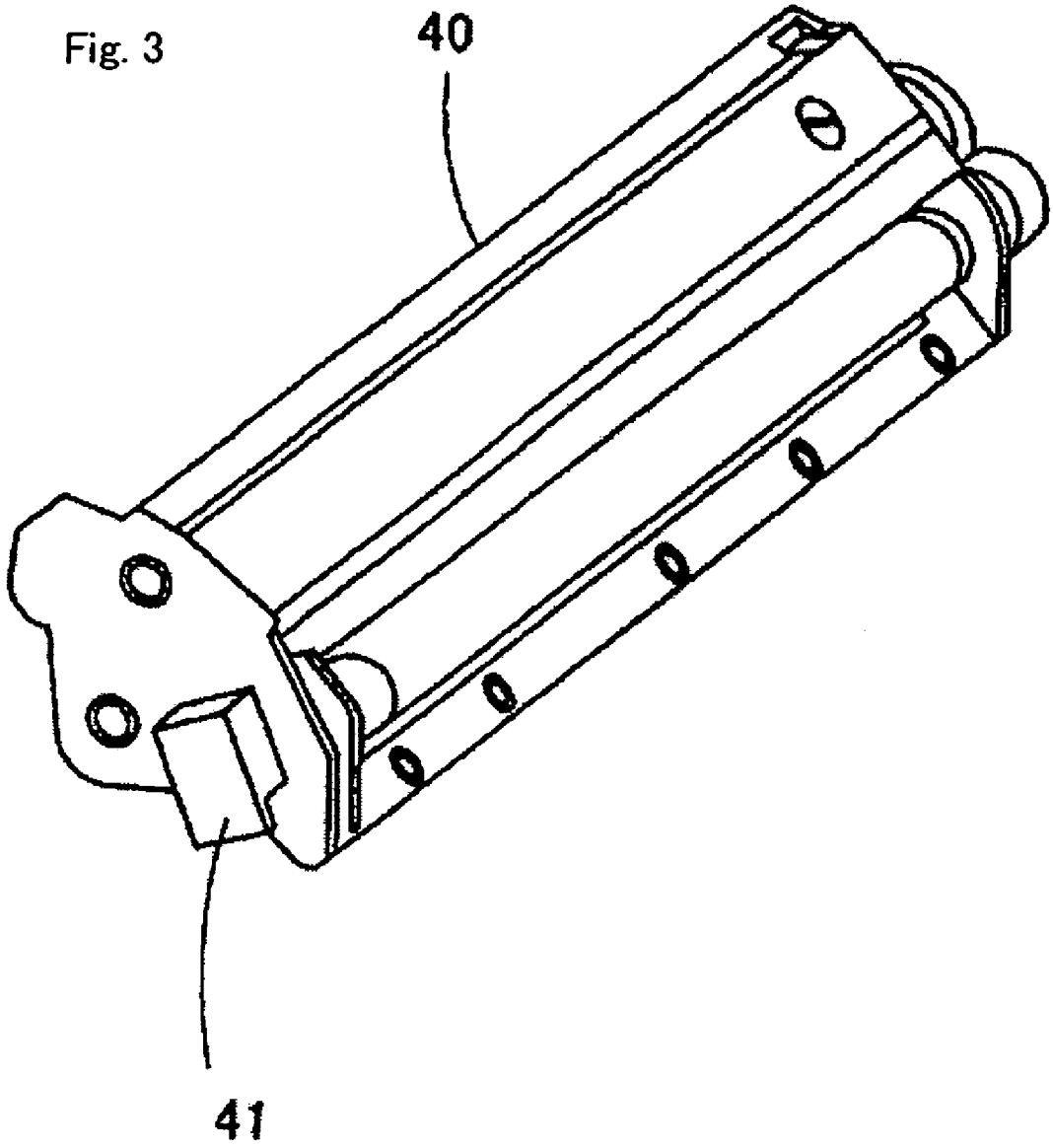
FIG. 3 illustrates the appearance of the toner cartridge 40.

FIG. 3 illustrates the appearance of the toner cartridge 40 as one example. In the structure of this embodiment, the storage element 50 is held in a holder unit 41 attached to an end of the toner cartridge 40.

Figure 4:
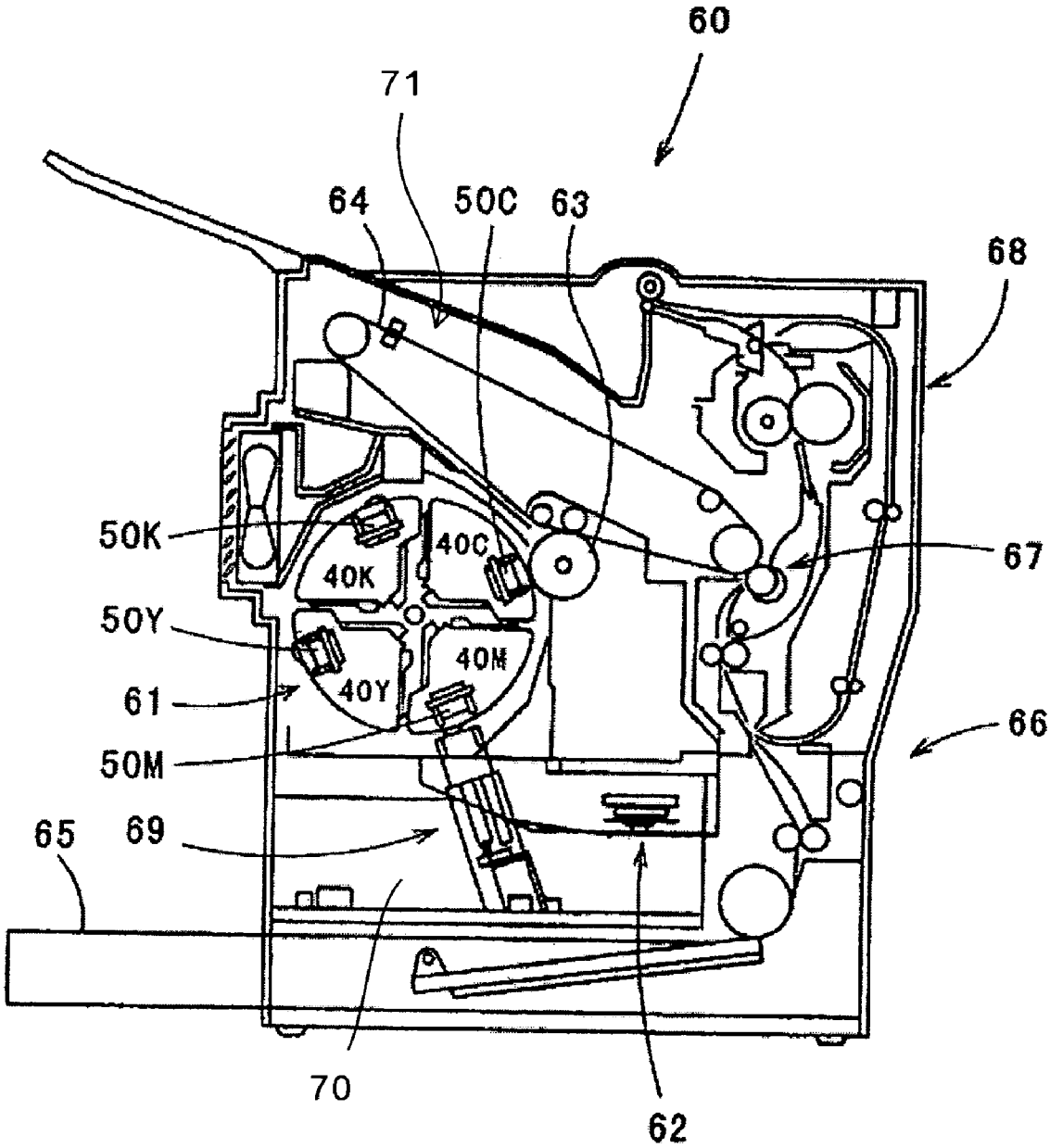
FIG. 4 schematically illustrates the structure of the color laser printer 60.

FIG. 4 schematically illustrates the structure of the color laser printer 60 with the toner cartridge 40 attached thereto. The color laser printer 60 is constructed as a full-color electrophotographic image formation device that adopts a single photoreceptor system and an intermediate transfer system. An original color image is subjected to color separation into four color image components of cyan (C), magenta (M), yellow (Y), and black (K). In the color laser printer 60, exposure unit 62 functions to generate electrostatic latent images of the respective color image components on a photoreceptor 63. Color toner images are formed on the electrostatic latent images on the photoreceptor 63 with color toners supplied from toner cartridges 40C, 40M, 40Y, and 40K of the respective colors set on a developer 61. A primary transfer unit 71 functions to transfer the color toner images in an overlapping manner onto a transfer belt 64 as an intermediate transfer member. A secondary transfer unit 67 then functions to transfer the four color toner images, which have been transferred to the transfer belt 64 in the overlapping manner, onto a sheet of printing paper that is supplied from a paper cassette 65 and is fed by means of a feeder unit 66. A fixation unit 68 functions to fuse and fix the transferred toner images on the printing paper, so as to complete a resulting color image on the printing paper. The developer 61 is designed to be rotatable and form the respective color toner images on the photoreceptor 63. The color laser printer 60 has a reader writer 69 that is arranged to face one of storage elements 50C, 50M, 50Y, and 50K of the toner cartridges 40C, 40M, 40Y, and 40K on the developer 61, which is rotated to be located at a lower left quadrant (in the drawing), across a predetermined distance. The reader writer 69 i s activated by a controller 70 to send an electromagnetic wave with information on the color laser printer 60 carried thereon and write the information on the color laser printer 60 into the storage element 50. The configuration of the parts relating to transmission of the electromagnetic waves between the reader writer 69 and the storage element 50 is similar to the configuration of the transmission-relating parts between the receiver transmitter 24 of the sorting apparatus 20 and the storage element 50 illustrated in FIG. 2, and is thus not specifically shown nor described here.

Figure 5:
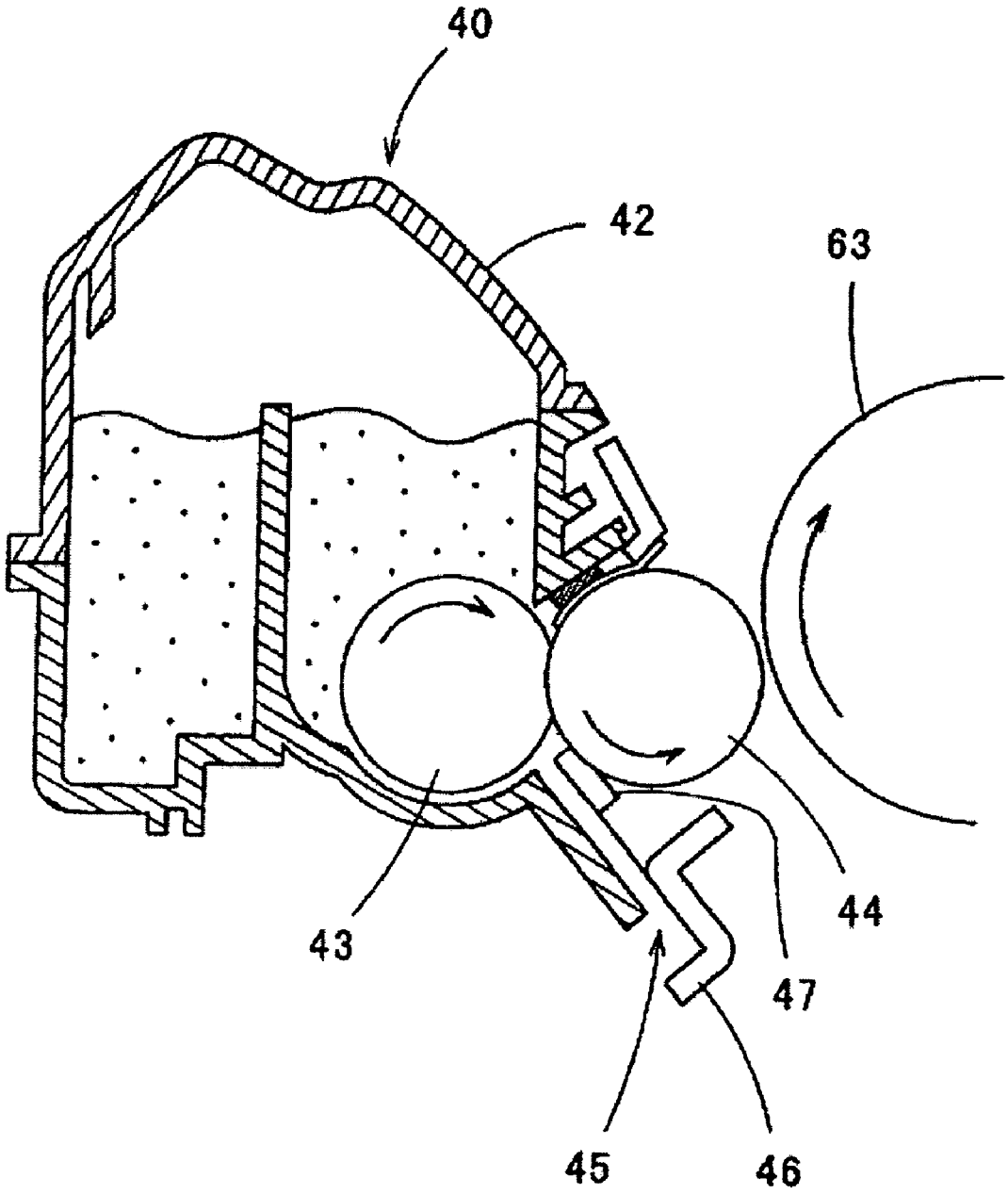
FIG. 5 is a sectional view showing the cross section of the toner cartridge 40.

FIG. 5 is a sectional view showing the cross section of the toner cartridge 40. The toner cartridge 40 has a housing 42 that is filled with a toner, a feed roller 43 that is located in the housing 42 and rotates to feed a supply of the toner from the housing 42 to outside, and a development roller 44 that engages with the feed roller 43 and rotates to hold and convey the supply of toner fed by the feed roller 43. The toner cartridge 40 also has a control blade 45 that is held on a support member 46 on its base and has an elastic member 47 on its edge. The elastic member 47 gives a thin layer of the toner held on the development roller 44 having a fixed depth. The development roller 44 conveys the thin layer of the toner formed by the control blade 45. The toner is thus stably supplied onto the photoreceptor 63 with the corresponding electrostatic latent image formed thereon.

FIG. 6 shows an example of the information stored in the storage element 50 of the toner cartridge 40. In this embodiment, the information stored in the storage element 50 includes an ID of the toner cartridge 40 (cartridge ID), the color of the toner, a record on the number of recycles of the toner cartridge 40, a record on the number of recycles of the feed roller 43, a record on the number of recycles of the development roller 44, an ID of the color laser printer 60 with the toner cartridge 40 attached thereto (printer ID), the model of the color laser printer 60, and a residual amount of the toner remaining in the toner cartridge 40. Among these pieces of information, the cartridge ID, the color of the toner, the record on the number of recycles of the toner cartridge 40, the record on the number of recycles of the feed roller 43, and the record on the number of recycles of the development roller 44 are written into the storage element 50 as factory defaults at the time of manufacturing or recycling the toner cartridge 40. The printer ID, the model of the color laser printer 60, and the residual amount of the toner are written into the storage element 50 by the controller 70 of the color laser printer 60 when the toner cartridge 40 is attached to or detached from the color laser printer 60.

Figure 7:
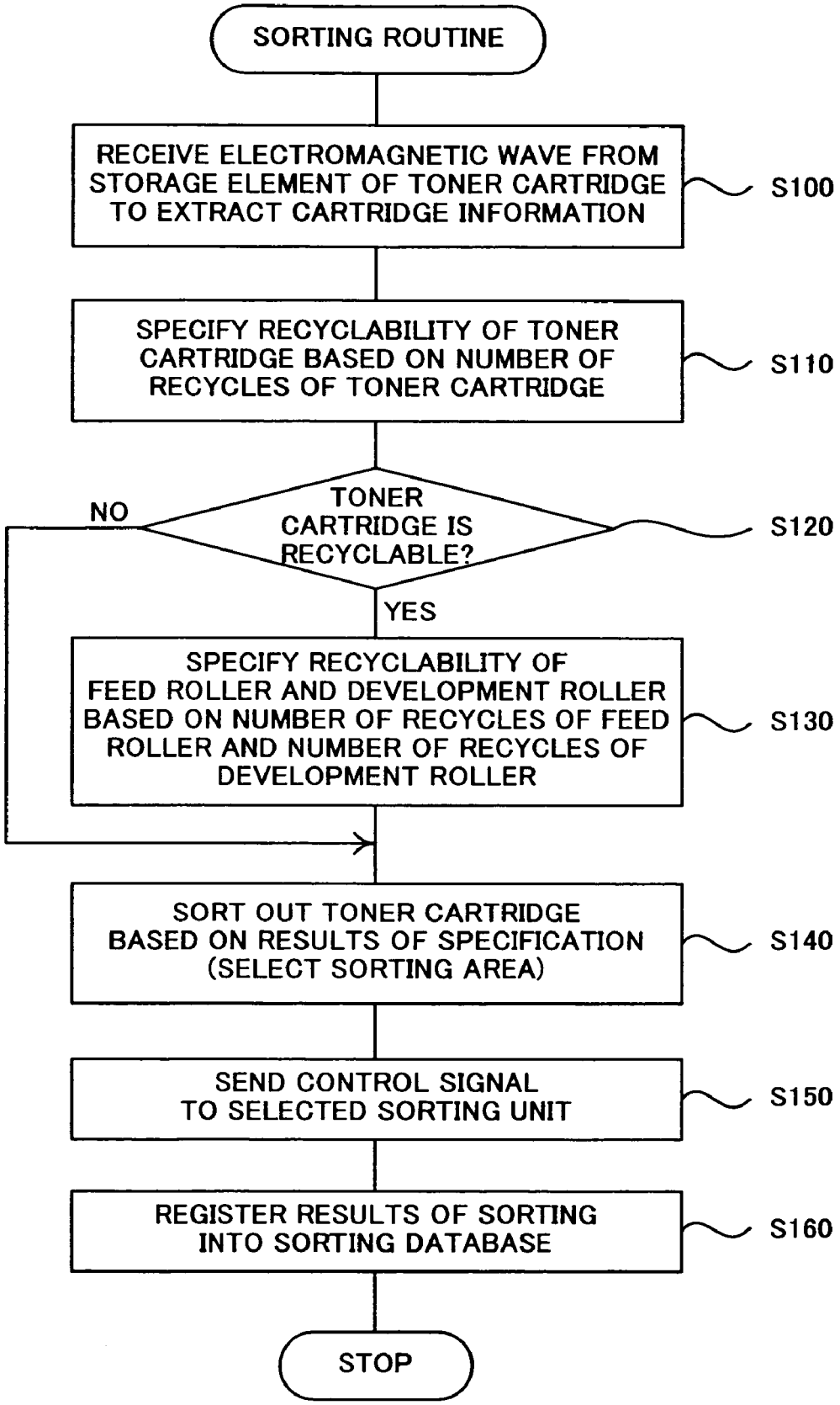
FIG. 7 is a flowchart showing a sorting routine.

The following describes the operations of the sorting apparatus 20 of the embodiment. FIG. 7 is a flowchart showing a sorting routine, which is executed by the sorting system 28 in the sorting apparatus 20 of the embodiment. This sorting routine is activated when the receiver-transmitter 24 receives an electromagnetic wave with information stored in the memory cell 94 from the storage element 50 of each collected toner cartridge 40 as a sorting object (step S100). The electromagnetic wave with the information on the toner cartridge 40 stored in the memory cell 94 is sent from the storage element 50 in response to reception of the information-acquisition electromagnetic wave, when each toner cartridge 40 as a sorting object is conveyed along the conveyor belt 30 and enters the preset coverage of the receiver-transmitter 24.

The sorting system 28 specifies the recyclability of the toner cartridge 40, based on the number of recycles of the toner cartridge 40 extracted from the information carried on the received electromagnetic wave (step S110). The procedure of this embodiment determines that the toner cartridge 40 is recyclable, when the number of recycles of the toner cartridge 40 is not greater than a preset number of times (for example, 3 times).

When it is determined that the toner cartridge 40 is recyclable (step S120), the sorting system 28 subsequently specifies the recyclability of the feed roller 43 and the recyclability of the development roller 44, based on the number of recycles of the feed roller 43 and the number of recycles of the development roller 44 extracted from the information carried on the received electromagnetic wave (step S130). The procedure of this embodiment determines that the feed roller 43 or the development roller 44 is recyclable, when the number of recycles of the feed roller 43 or the number of recycles of the development roller 44 is not greater than a preset number of times (for example, 2 times).

The sorting system 28 then sorts out the toner cartridge 40, in order to send the toner cartridge 40 to a selected one of the sorting areas 34*a* through 34*c*, based on the results of the specification of recyclability of the toner cartridge 40, the feed roller 43, and the development roller 44 (step S140). The procedure of this embodiment specifies a subsequent operation corresponding to a combination of the results of the specification of recyclability and sorts out the toner cartridge 40 according to the specified subsequent operation. FIG. 8 is a map showing the subsequent operation and the selection of the sorting area with respect to each combination of the results of the specification of recyclability. A combination of the recyclable toner cartridge 40, the recyclable feed roller 43, and the recyclable development roller 44 requires 'supplement of toner' as the subsequent operation and selects the sorting area 34*a*. A combination of the recyclable toner cartridge 40, the unrecyclable feed roller 43, and the unrecyclable development roller 44 requires 'replacement of part' as the subsequent operation and selects the sorting area 34*b*. The unrecyclable toner cartridge 40 requires 'wastage' as the subsequent operation and selects the sorting area 34*c*.

On completion of sorting the toner cartridge 40, the sorting system 28 sends a control signal to a corresponding one of the sorting units 32*a* through 32*c* to guide the toner cartridge 40 to the selected one of the sorting areas 34*a* through 34c (step S150) and registers the results of sorting into the sorting database 26 (step S160). The sorting routine is then terminated. FIG. 9 shows an example of information under management in the sorting database 26. The information stored in the sorting database 26 includes a cartridge ID allocated to each toner cartridge 40 as an object of the sorting routine, the color of the toner, requirement or non-requirement for replacement of the feed roller 43, requirement or non-requirement for replacement of the development roller 44, and a residual amount of the toner. Among these pieces of information, the cartridge ID, the color of the toner, and the residual amount of the toner are registered directly from the information carried on the electromagnetic wave received at step S100. The requirement or non-requirement for replacement of the feed roller 43 and the requirement or non-requirement for replacement of the development roller 44 are registered, based on the results of specification of the recyclability at step S130.

Figure 10:
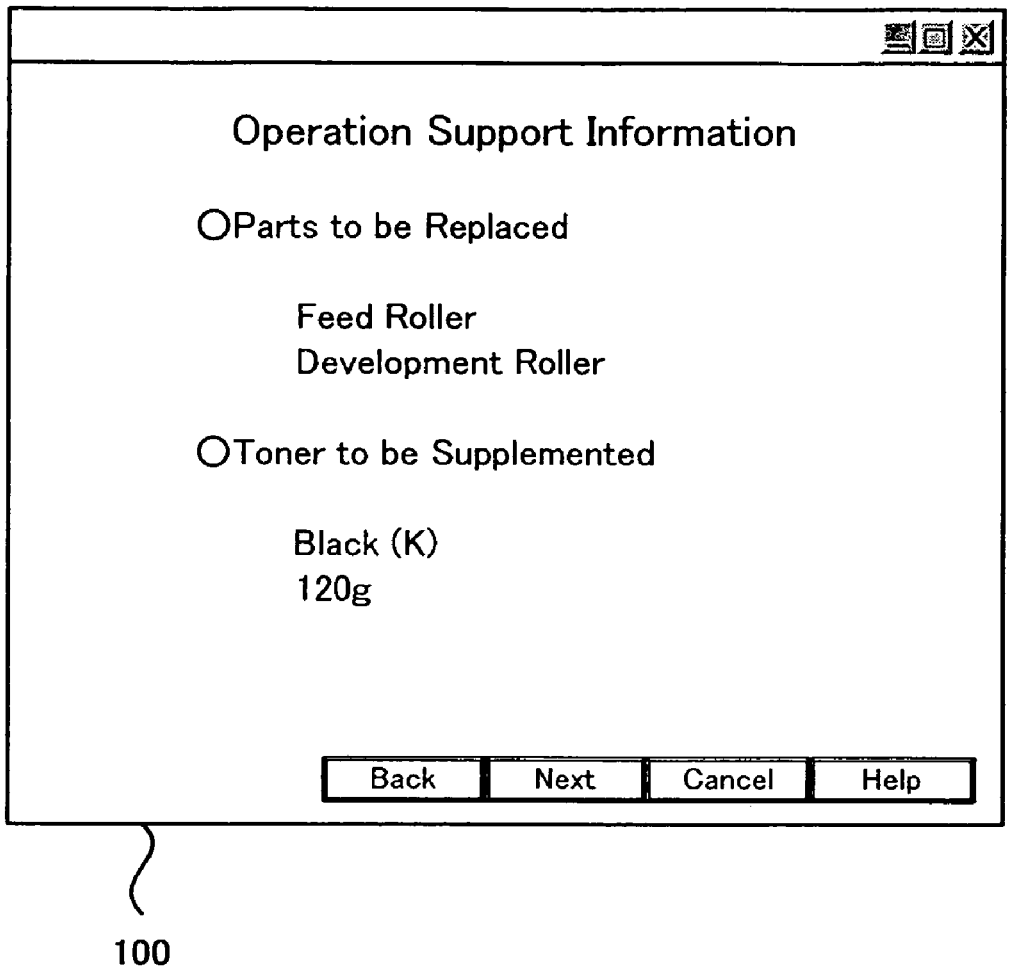
FIG. 10 shows an example of an operation support information window 100.

The information registered in the sorting database 26 is utilized as operation support information for the subsequent recycling operation. In an illustrated example of FIG. 10, an operation support information window 100 displays information regarding the parts to be replaced and the toner to be supplemented, for example, the color and the required supply of the toner. The required supply of the toner is calculated by subtracting the residual amount of toner from the full fill of the toner cartridge 40.

As described above, the sorting apparatus 20 of the embodiment receives the electromagnetic wave from the storage element 50 of each toner cartridge 40, which has been conveyed and entered the preset coverage of the receiver-transmitter 24. The sorting apparatus 20 then specifies the recyclability of the toner cartridge 40, based on the information extracted from the received electromagnetic wave, for example, the number of recycles of the toner cartridge 40, and sorts out the toner cartridge 40. This arrangement readily obtains information from each used toner cartridge 40 packed in a cardboard box and automatically sorts out the toner cartridge 40 based on the obtained information. The technique of the embodiment thus ensures efficient sorting of used toner cartridge 40.

The receiver-transmitter 24 of the sorting apparatus 20 in the embodiment corresponds to the electromagnetic wave transmission module of the invention. The sorting system 28 executing the processing of step S100, the processing of step S110, the processing of steps S130 and S140, and the processing of step S150 in the sorting routine of FIG. 7 respectively correspond to the information reception module, the recyclability specification module, the sorting module, and the sorting unit control module of the invention. The sorting database 26 and the operation support information window 100 respectively correspond to the information storage module and the support information output module of the invention.

The sorting apparatus 20 of the embodiment specifies the subsequent operation, based on the combination of the results of specification of the recyclability with regard to the toner cartridge 40, the feed roller 43, and the development roller 44, and sorts out the toner cartridge 40 corresponding to the specified subsequent operation. One possible modification may not specify the subsequent operation but may simply sort out the toner cartridge 40 corresponding to the combination of the results of specification of the recyclability. Specification of the recyclability of the toner cartridge 40 and its components is not restrictive at all. Any other suitable rules may be adopted to sort out each toner cartridge 40, based on the information regarding the toner cartridge 40.

The sorting apparatus 20 of the embodiment determines the recyclability of each toner cartridge 40, based on the record on the number of recycles of the toner cartridge 40. Other pieces of information regarding the toner cartridge 40 may alternatively be used to determine the recyclability of the toner cartridge 40. One applicable procedure may determine that the toner cartridge 40 is recyclable when the residual amount of the toner in the toner cartridge 40 is not less than a predetermined level. Another applicable procedure may determine the recyclability of the toner cartridge 40, based on the number of recycles of the feed roller 43 and the number of recycles of the development roller 44.

The sorting apparatus 20 of the embodiment registers the results of the sorting process into the sorting database 26 and utilizes the registered information as the operation support information. Registration of the results of the sorting process into the sorting database 26 and use of the registered information as the operation support information are not essential and may be omitted according to the requirements.

The sorting apparatus 20 of the embodiment sends a control signal to a corresponding one of the sorting units 32*a* through 32*c* to guide each toner cartridge 40 to a selected one of the sorting areas 34*a* through 34*c*. Any of other diverse methods may be applied to actual sorting of each toner cartridge 40.

The sorting apparatus 20 of the embodiment sorts out each collected, used toner cartridge 40, based on the information read from the storage element 50 of the toner cartridge 40. The technique of the embodiment is also applicable to sort out any other units and components included in the color laser printer 60, for example, the photoreceptor 63, the secondary transfer unit 67, and the fixation unit 68. In any case, an object unit is required to have a storage element for storing information regarding the object unit. The procedure reads information from the storage element of the object unit and sorts out the object unit.

The sorting apparatus 20 of the embodiment sorts out each toner cartridge 40 attached to the color laser printer 60, which is constructed as the full-color electrophotographic image formation device that adopts the single photoreceptor system and the intermediate transfer system. The technique of the embodiment is also applicable to sort out any object unit or component included in any of color laser printers and color photocopiers constructed as full-color electrophotographic image formation devices adopting a multi-photoreceptor system and a direct transfer system, as well as monochromatic laser printers and monochromatic photocopiers constructed as monochromatic electrophotographic image formation devices. The technique of the embodiment is further applicable to sort out any object unit (for example, an ink cartridge) included in an inkjet printer. In general the technique of the invention is applied to sort out any object unit or component that has a storage element and is included in any predetermined device.

The embodiment regards the sorting apparatus 20 that sorts out each collected, used toner cartridge 40. The system configuration including the sorting apparatus 20 of the embodiment shown in FIG. 1 may be applied to a system including an operation verification apparatus that verifies a recycling-related operation. This verification system updates the information on the toner cartridge 40 (for example, the numbers of recycles of the toner cartridge 40, the feed roller 43, and the development roller 44) stored in the storage element 50 of the toner cartridge 40 on completion of a recycling-related operation, and compares the updated information on the toner cartridge 40 received from the storage element 50 of the toner cartridge 40 conveyed along the conveyor belt 30 with the information registered in the sorting database 26 (that is, the existing information prior to the recycling-related operation). The system verifies the recycling-related operation, based on a result of the comparison. In this system, the information regarding the numbers of recycles of the toner cartridge 40, the feed roller 43, and the development roller 44 prior to the recycling-related operation may be registered into the sorting database 26 at step S160 in the sorting routine of FIG. 7.

In the above embodiment, the technique of the present invention is applied to the sorting apparatus 20 that sorts out the collected toner cartridge for recycle, based on the information received from the storage element included in the toner cartridge. The technique of the invention is also applicable to a sorting method in relation to the sorting apparatus of the embodiment. Another application is a program that causes one or multiple computers to function as the sorting apparatus of the embodiment. In the case of such a program, the respective steps of the sorting routine shown in FIG. 7 may be programmed in a suitable programming language.

The above embodiment is to be considered in all aspects as illustrative and not restrictive. There may be many modifications, changes, and alterations without departing from the scope or spirit of the main characteristics of the present invention. All changes within the meaning and range of equivalency of the claims are therefore intended to be embraced therein.

What is claimed is:

1. A sorting apparatus that sorts out a collected object unit for recycle, where the object unit is attachable in a predetermined device and has a storage element, which stores information regarding the object unit and sends the stored information on an electromagnetic wave in a predetermined frequency band, in response to reception of a specific electromagnetic wave in the predetermined frequency band, said sorting apparatus comprising:

an electromagnetic wave transmission module that sends the specific electromagnetic wave in the predetermined frequency band to a preset coverage area;

an information reception module that receives the information regarding the object unit, which is carried on the electromagnetic wave in the predetermined frequency band and is sent from the storage element of the collected object unit entering the preset coverage area, in response to transmission of the specific electromagnetic wave in the predetermined frequency band; and a sorting module that sorts out the object unit for recycle, based on the received information regarding the object unit.

2. A sorting apparatus in accordance with claim 1, wherein the predetermined device is an image formation device that forms an image on a medium like paper, and the object unit is any one of a recording material cartridge, a photoreceptor unit, a transfer unit, and a fixation unit.

3. A sorting apparatus in accordance with claim 1, wherein said sorting module comprises a recyclability specification module that specifies recyclability of the object unit, based on the received information regarding the object unit, said sorting module sorting out the object unit according to the specified recyclability.

4. A sorting apparatus in accordance with claim 3, wherein the information regarding the object unit includes a record on a number of recycles of the object unit, and said recyclability specification module determines that the object unit is recyclable when the number of recycles is not greater than a preset number of times.

5. A sorting apparatus in accordance with claim 3, wherein the information regarding the object unit includes a record on a number of recycles of a component included in the object unit, and said recyclability specification module determines that the object unit is recyclable when the number of recycles is not greater than a preset number of times.

6. A sorting apparatus in accordance with claim 3, wherein the object unit is a recording material cartridge of an image formation device, the information regarding the object unit includes information on a residual amount of a recording material, and said recyclability specification module determines that the object unit is recyclable when the residual amount of the recording material is not less than a preset level.

7. A sorting apparatus in accordance with claim 3, wherein said sorting module, when said recyclability specification module determines that the object unit is recyclable, specifies a recycling-related operation based on the received information regarding the object unit and sorts out the object unit corresponding to the specified recycling-related operation.

8. A sorting apparatus in accordance with claim 1, said sorting apparatus further comprising:

an information storage module that stores the information received by said information reception module and information regarding a result of sorting by said sorting module; and a support information output module that outputs support information for a recycling-related operation, based on the information stored in said information storage module.

9. A sorting apparatus in accordance with claim 1, said sorting apparatus further comprising:

a sorting unit control module that controls a sorting unit, which actually sorts out the object unit according to a result of sorting of the object unit by said sorting module.

10. An operation verification apparatus that verifies a recycling-related operation of an object unit, which is attachable in a predetermined device and is sorted out for recycle by a sorting apparatus, said operation verification apparatus comprising:

an information acquisition module that acquires information regarding the object unit after the recycling-related operation from a storage element of the object unit; and a verification module that verifies the recycling-related operation, based on a result of comparison between the acquired information and information on sorting of the object unit stored in an information storage module of said sorting apparatus.

11. An operation verification apparatus in accordance with claim 10, wherein the sorting apparatus sorts out a collected object unit for recycle, where the object unit is attachable in a predetermined device and has a storage element, which stores information regarding the object unit and sends the stored information on an electromagnetic wave in a predetermined frequency band, in response to reception of a specific electromagnetic wave in the predetermined frequency band, the sorting apparatus comprising: an electromagnetic wave transmission module that sends the specific electromagnetic wave in the predetermined frequency band to a preset coverage area; an information reception module that receives the information regarding the object unit, which is carried on the electromagnetic wave in the predetermined frequency band and is sent from the storage element of the collected object unit entering the preset coverage area, in response to transmission of the specific electromagnetic wave in the predetermined frequency band; and a sorting module that sorts out the object unit for recycle, based on the received information regarding the object unit.

12. A sorting method that sorts out a collected object unit for recycle, where the object unit is attachable in a predetermined device and has a storage element, which stores information regarding the object unit and sends the stored information on an electromagnetic wave in a predetermined frequency band, in response to reception of a specific electromagnetic wave in the predetermined frequency band, said sorting method comprising the steps of:

(a) sending the specific electromagnetic wave in the predetermined frequency band to a preset coverage area;

(b) receiving the information regarding the object unit, which is carried on the electromagnetic wave in the predetermined frequency band and is sent from the storage element of the collected object unit entering the preset coverage area, in response to transmission of the specific electromagnetic wave in the predetermined frequency band; and (c) sorting out the object unit for recycle, based on the received information regarding the object unit.

13. A sorting method in accordance with claim 12, wherein said step (c) comprises the step (c1) that specifies recyclability of the object unit, based on the received information regarding the object unit, and the step (c2) that sorts out the object unit according to the specified recyclability.

14. A sorting method in accordance with claim 13, wherein the information regarding the object unit includes a record on a number of recycles of at least one of components included in the object unit, and said step (c1) determines that the object unit is recyclable when the number of recycles is not greater than a preset number of times.

15. A sorting method in accordance with claim 13, wherein the object unit is a recording material cartridge of an image formation device, the information regarding the object unit includes information on a residual amount of a recording material, and said step (c1) determines that the object unit is recyclable when the residual amount of the recording material is not less than a preset level.

16. A sorting method in accordance with claim 13, wherein said step (c2), when said step (c1) determines that the object unit is recyclable, specifies a recycling-related operation based on the received information regarding the object unit and sorts out the object unit corresponding to the specified recycling-related operation.

17. A sorting method in accordance with claim 12, said sorting method further comprising the step of controlling a sorting unit, which actually sorts out the object unit according to a result of sorting of the object unit by said step (c).

18. A sorting apparatus in accordance with claim 3, wherein the object unit is a recording material cartridge, and the recycling-related operation is any one of a supplement recording material, a replacement of part and a wastage.

* * * * *